US006336439B1

(12) United States Patent
Frohn et al.

(10) Patent No.: US 6,336,439 B1
(45) **Date of Patent: *Jan. 8, 2002**

(54) METHOD OF CONTROLLING AN INTERNAL-COMBUSTION ENGINE BY SWITCHING BETWEEN TWO ENGINE CONTROL SYSTEMS DURING ENGINE RUN

(75) Inventors: Wilfried Frohn, Alsdorf; Ekkehard Schrey, Aachen, both of (DE)

(73) Assignee: FEV Motorentechnik GmbH, Aachen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/965,953

(22) Filed: Nov. 7, 1997

(30) Foreign Application Priority Data

Nov. 7, 1996 (DE) ..... 196 45 826

(51) Int. Cl.[7] ..... F02B 5/00
(52) U.S. Cl. ..... 123/406.13; 123/479
(58) Field of Search ..... 123/406.13, 479, 123/690; 701/114

(56) References Cited

U.S. PATENT DOCUMENTS 4,791,569 A * 12/1988 Suzuki ..... 364/431.04
5,372,112 A * 12/1994 Ohtaka et al. ..... 123/406.13
5,497,751 A * 3/1996 Ohtake ..... 123/479
5,605,135 A * 2/1997 Netherwood ..... 123/479

* cited by examiner

*Primary Examiner*—John Kwon
(74) *Attorney, Agent, or Firm*—Venable; Gabor J. Kelemen

(57) ABSTRACT

A method of controlling functions of an internal-combustion engine having electrically operated actuators for controlling engine functions, includes the following steps: detecting control-relevant operational data by a sensor arrangement; applying the detected operational data to a first, engine-integrated electronic engine control system; controlling the actuators by control signals from the first electronic engine control system through a power unit; applying the operational data to a second, external electronic engine control system in synchronism with the operational data applied to the first electronic engine control system; generating control signals at an output of the second electronic engine control system; applying, to the power unit, control signals emanating from the second electronic engine control system for the actuator of at least one selected engine function; and simultaneously with the preceding step, removing from the power unit control signals emanating from the first electronic engine control system for the actuator serving the selected engine function. As a result, engine control is simultaneously effected by the first and second electronic engine control systems such that the selected engine function is controlled by the second electronic engine control system and the remaining engine functions are controlled by the first electronic engine control system.

3 Claims, 4 Drawing Sheets

METHOD OF CONTROLLING AN INTERNAL-COMBUSTION ENGINE BY SWITCHING BETWEEN TWO ENGINE CONTROL SYSTEMS DURING ENGINE RUN

CROSS REFERENCE TO RELATED APPLICATION

This application claims the priority of German Application No. 196 45 826.9 filed Nov. 7, 1996, which is incorporated herein by reference.

BACKGROUND OF THE INVENTION

Internal-combustion engines, particularly of the reciprocating piston type are increasingly provided with electrically triggered and/or operated actuators for a great variety of engine functions. Such actuators are operated by means of at least one power unit of an integrated electronic engine control system which senses the control-relevant operational data of the engine by means of sensors.

To be able to perform tests and investigations of the individual engine functions during engine run, a great variety of parameters, such as the moment of ignition, the injected fuel quantity, the moment of injection, operating times of the cylinder valves—to name only the most important ones—have to be predetermined and must be changeable. Previously, such operations have been carried out, among others, by disconnecting the integrated electronic engine control system and replacing it by an external engine control system. Such a conventional switchover measure has to be performed, however, during a standstill of the engine and is therefore very time consuming.

SUMMARY OF THE INVENTION

It is an object of the invention to provide an improved method of the above-outlined kind with which the discussed engine tests may be performed during engine run and which, at the same time, offers the possibility of externally interfering with the control of selected engine functions.

This object and others to become apparent as the specification progresses, are accomplished by the invention, according to which, briefly stated, the method of controlling functions of an internal-combustion engine having electrically operated actuators for controlling engine functions, includes the following steps: detecting control-relevant operational data by a sensor arrangement; applying the detected operational data to a first, engine-integrated electronic engine control system; controlling the actuators by control signals from the first electronic engine control system through a power unit; applying the operational data to a second, external electronic engine control system in synchronism with the operational data applied to the first electronic engine control system; generating control signals at an output of the second electronic engine control system; applying, to the power unit, control signals emanating from the second electronic engine control system for the actuator of at least one selected engine function; and simultaneously with the preceding step, removing from the power unit control signals emanating from the first electronic engine control system for the actuator serving the selected engine function. As a result, engine control is simultaneously effected by the first and second electronic engine control systems such that the selected engine function is controlled by the second electronic engine control system and the remaining engine functions are controlled by the first electronic engine control system.

The particular advantage of the invention as outlined above resides in that during tests not all signals necessary for the overall engine operation are switched over to the external engine control system which would then take over the entire engine operation, but only those which are required for the examination of the selected engine functions. For example, for examining variations of the moment of ignition, only the signals required for the ignition are switched over to the external engine control system, while the control of the injection and all other operational functions of the engine continue to be controlled by the engine's own integrated engine control system. Conversely, the moment of injection and quantity of injected fuel may be varied by the external engine control system, while the ignition continues to be controlled by the integrated engine control system.

In the above-outlined method according to the invention individual or groupwise selected engine functions may be controlled and varied by the external engine control system. Engine functions which may be handled in this manner are, for example, the exhaust gas reintroduction, the idling regulation, and the change of the valve control times of electromagnetically operated cylinder valves. Additional functions, such as the control of an air conditioning unit, a fan or the like may also be considered as engine functions as far as the present invention is concerned. It is always feasible to direct the engine operation generally by the integrated engine control system and to direct only the selected engine function from the external engine control system which is expediently freely programmable. Thus, the method according to the invention offers not only the possibility for an optimized operation but also provides an excellent opportunity for a direct comparison between the different engine controls to thus find and directly test possible improvement potentials without circumstantial restructuring work.

According to a particularly advantageous feature of the invention, the deactivation of the control signals of the integrated engine control system and the activation of the corresponding control signals of the external engine control system are effected at a moment when no control signals are present at the outputs of either engine control system. In this connection the fact is advantageously utilized that particularly in reciprocating piston engines practically all actuators are periodically operated, so that periods are always available in which at least the selected actuator is idle. If the switchover is effected in a period between two control signals, a switchover in a running engine is achieved without adversely interfering with the engine operation.

DESCRIPTION OF THE PREFERRED EMBODIMENTS

Figure 1:
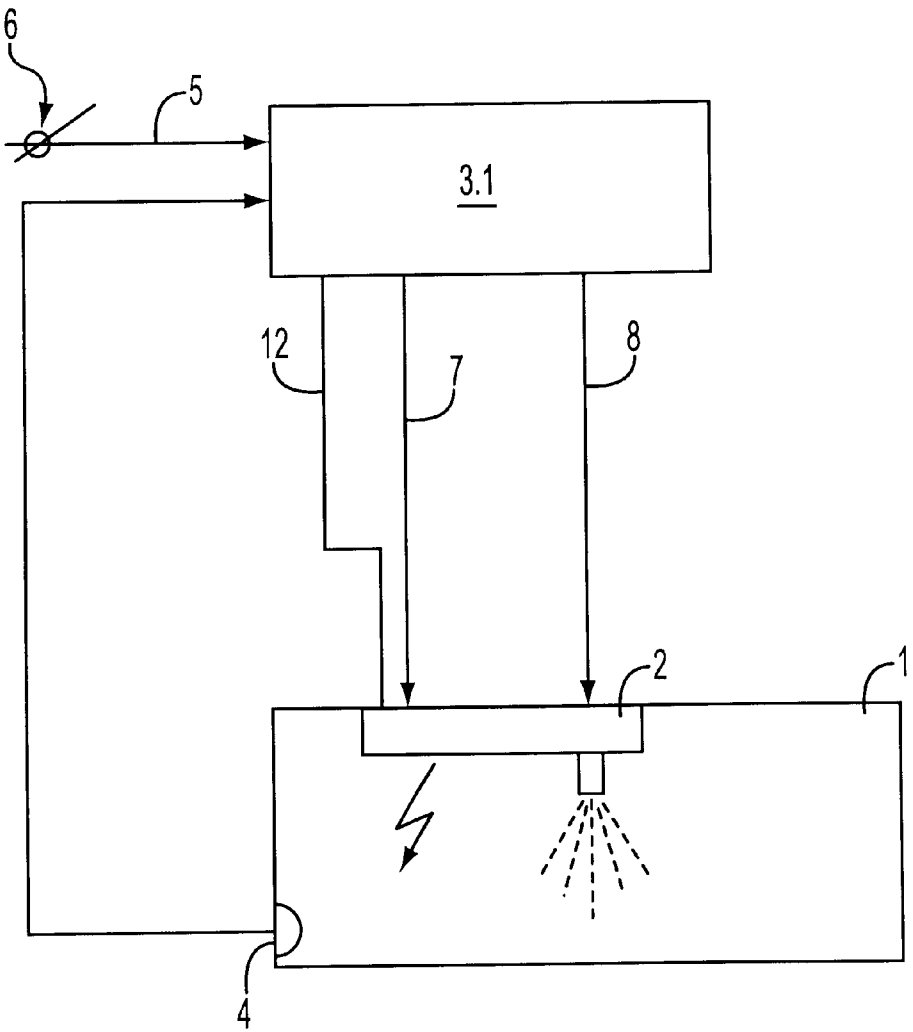
FIG. 1 is a block diagram of a piston-type internal-combustion engine having an integrated electronic engine control system.

The block diagram of FIG. 1 schematically illustrates a reciprocating piston-type internal-combustion engine 1

(hereafter also referred to as "engine"), whose electrical actuators are operated by means of a power unit 2 for a number of engine functions such as ignition, fuel injection, exhaust gas return and/or idling run. The control of the power unit 2 is effected by an integrated electronic engine control system 3.1 which detects the control-relevant operational data of the engine 1 by suitable sensors 4 and which, by means of a further signal input 5 receives the desired load condition by virtue of the setting of an accelerating pedal 6. The sensors 4 (only one is schematically shown in FIG. 1) detect, as operationally relevant data, for example, the rpm, the crankshaft position at the first cylinder, the engine temperature, the pressure of the intake air in the intake pipe, etc. For the embodiment to be described, only the signal output 7 for the ignition and the signal output 8 for the fuel injection are shown at the integrated engine control system 3.1.

Figure 2:
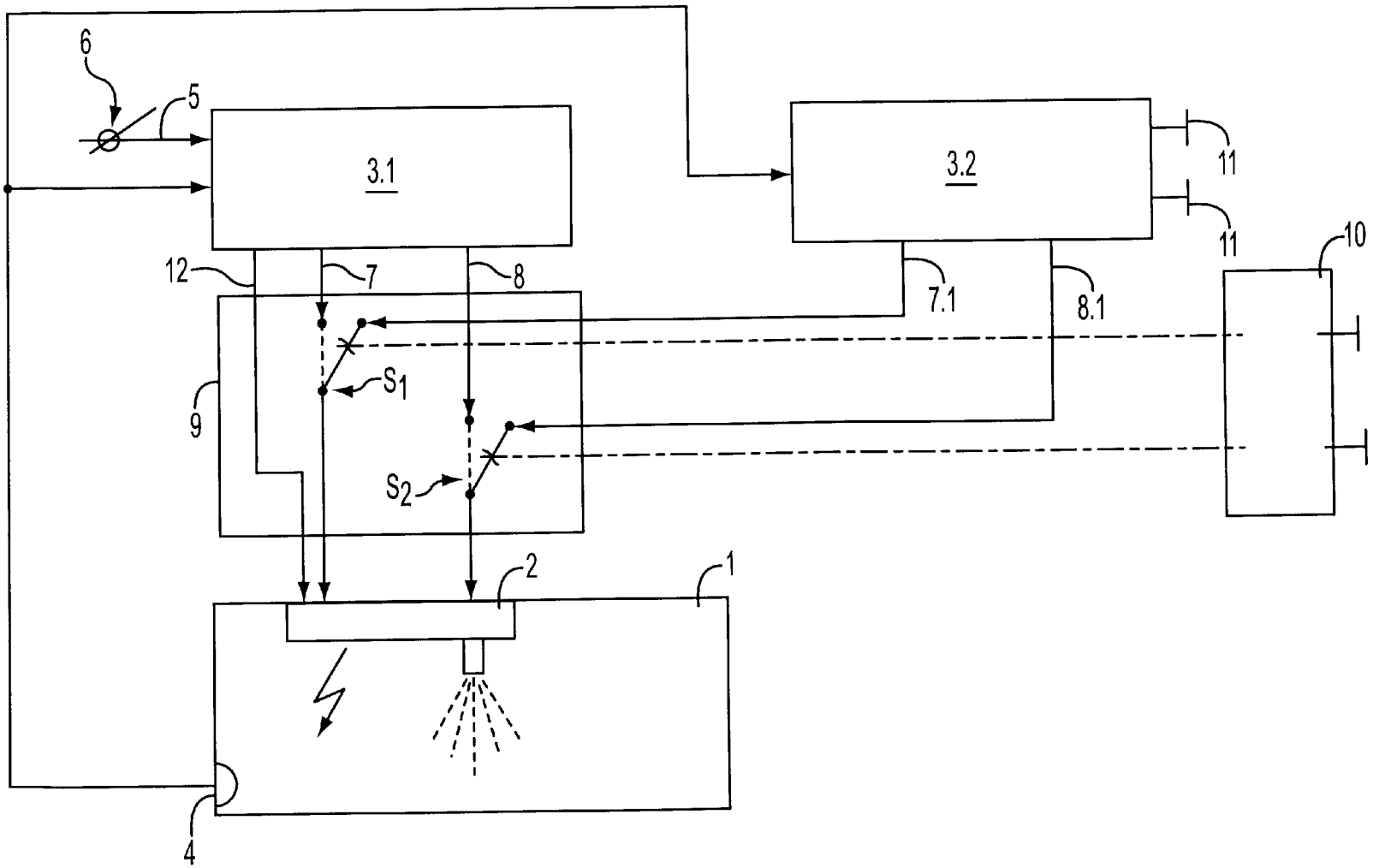
FIG. 2 is a block diagram of the engine according to FIG. 1 including an external engine control system operatively coupled to the engine for affecting two selected engine functions.

In the block diagram according to FIG. 2, between the power unit 2 at the engine 1 and the integrated electronic engine control system 3.1 a coupling logic 9 is disposed which is connected to an external, second electronic engine control system 3.2. The coupling logic 9 as well as the external engine control system 3.2 are connected with the sensors 4, so that the relevant operational data appear synchronously at both engine control systems 3.1 and 3.2.

The external engine control system 3.2 has, similarly to the outputs 7 and 8 of the engine control system 3.1, signal outputs 7.1 and 8.1 for the ignition and the fuel injection. The signal outputs 7, 8 and 7.1, 8.1 are coupled to respective switches $S_1$ and $S_2$ which, in turn, are connected to a switch-operating unit 10, so that the control of the ignition and/or the fuel injection may be selectively switched from the engine control system 3.1 to the engine control system 3.2. The engine control system 3.2 is so designed that by means of suitable inputted signals 11, for example, the moment of ignition as well as the moment of fuel injection and the duration of injection may be changed, departing from the values preset in the engine control system 3.1.

With the aid of the coupling logic 9 and its switches $S_1$ and $S_2$ it is possible, for example, to control the fuel injection via the switch $S_2$ from the integrated engine control system 3.1 and after switchover by the control logic 9, to operate the ignition from the external engine control system 3.2. All other non-illustrated controls which are operated by electric actuators at the engine 1 continue to be operated from the integrated engine control system 3.1 as schematically illustrated by the signal conduit 12.

It may be readily derived from the block diagram of FIG. 2 that dependent on the design of the engine controls and the desired number of the engine functions to be affected, a corresponding number of switches may be provided in the coupling logic 9, so that one or more engine functions may be arbitrarily controlled by the external engine control system 3.2 which preferably may be freely programmed, whereas all the other functions may continue to be controlled by the engine's own engine control system 3.1.

To avoid, despite the synchronization, incorrect control operations due to a switchover at the wrong moment, such a switchover should occur only at a time when no control signal is present at either engine control system 3.1 or 3.2 for the engine function selected to be switched over from one engine control system to the other. Such a condition will be further explained in conjunction with FIG. 3 which shows, in a time-synchronized illustration, the various control signals emanating from the engine control systems 3.1 and 3.2 for two engine functions, namely, fuel injection and ignition.

The signal curve 3.1 E and the signal curve 3.2 E indicate the control signals for the injection appearing at the signal conductor 8 and 8' of the two engine control systems 3.1 and 3.2, respectively. Ignition and fuel injection are to be switched over to the engine control system 3.2 while the engine is running.

The signal curve 3.1 Z and the signal curve 3.2 Z indicate the control signal for the ignition as it appears at a given moment at the signal outputs 7 and 7.1 of the two engine control systems 3.1 and 3.2.

The signal curves 9 E and 9 Z show the corresponding output signals of the coupling logic 9, applied to the power unit 2.

In the coupling logic 9 the switches $S_1$ and $S_2$ are first so set that the engine control system 3.1 controls directly the power unit 2 via the signal conductors 7 and 8. The engine control system 3.2 is independent from the just-described arrangement so that at the signal outputs 7.1 and 8.1 changed control signals corresponding to the changed settings appear. These changed control signals, however, have no effect yet on the power unit 2. Such an event can take place only when a switchover to the engine control system 3.2 is effected by the switches.

Figure 3:
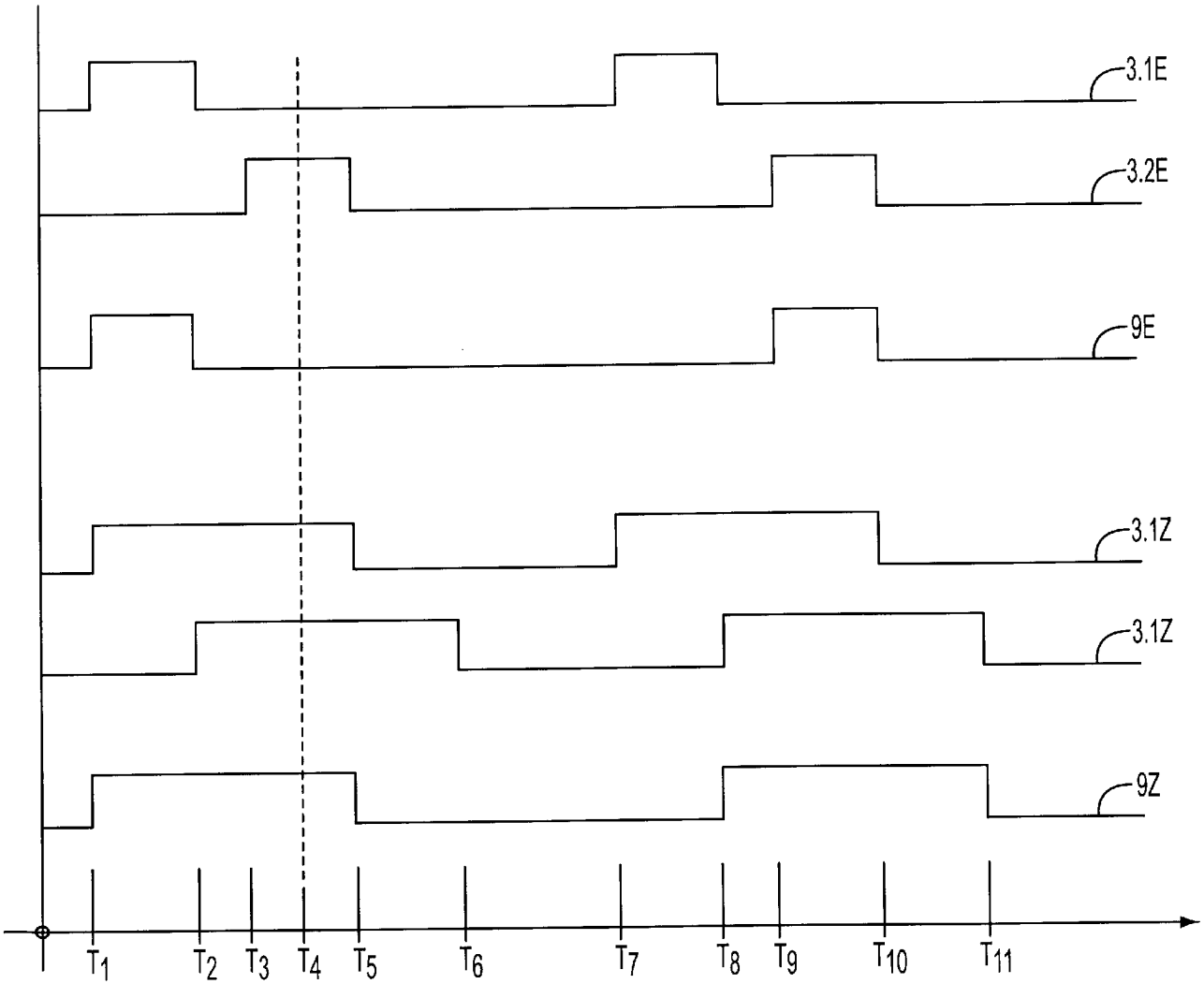
FIG. 3 is a diagram showing signals for injection and ignition functions, appearing at two engine control systems.

As it may be observed in the diagram illustrated in FIG. 3, first a control of the power unit 2 is effected by the engine control system 3.1. This may be recognized by the fact that in each instance the output signals 9 E and 9 Z appearing at the coupling logic 9 are identical to the associated signals 3.1 E and 3.1 Z in the predetermined period $T_0$ to $T_5$. The output signals 3.2 E and 3.2 Z appearing at the engine control system 3.2 cannot become effective because of the switching position of the switches $S_1$ and $S_2$; rather, those signals are blocked by the coupling logic 9.

As it may also be observed in FIG. 3, dependent upon the engine cycle, at the moment $T_1$ the signal 3.1 E for the fuel injection and the signal 3.1 Z for the ignition are activated by the engine control system 3.1. At the same time, the output signals are released by the coupling logic 9. At the moment $T_2$ the fuel injection signal 3.1 E is again removed. Based on the predetermined data in the external engine control system 3.2, at the moment $T_2$ at the engine control system 3.2 the changed output signal 3.1 Z and at the moment $T_3$ the changed output signal 3.2 E appear. Since, however, the coupling logic 9 is still connected to the engine control system 3.1, these signals have no effect but are blocked by the coupling logic 9.

At moment $T_4$ the coupling logic 9 is prepared for switchover to the engine control system 3.2 as concerns the ignition and the fuel injection functions. Since, however, the circuit is designed such that a switchover of the respective signals is possible only when no corresponding signal to be switched over is activated, the switchover cannot yet be carried out at moment $T_4$.

At moment $T_5$ the predetermined, although inactive injection signal 3.2 E of the engine control system 3.2 and the active ignition signal 9 Z predetermined by the engine control system 3.1 drop to zero. Since at moment $T_5$ no output signal for the injection is present either at the engine control system 3.1 or at the engine control system 3.2, the coupling logic 9 switches the associated switch $S_2$ from the engine control system 3.1 to the engine control system 3.2.

Since at moment $T_6$ the still inactive ignition signal 3.2 Z appearing at the engine control 3.2 also drops to zero and prior to moment $T_7$ still no output signals appear at the engine control systems, the switch $S_1$ too, switches over from the engine control system 3.1 to the engine control system 3.2 during the time interval between moments $T_6$ and $T_7$, so that both functions, that is, "injection" and "ignition" may be taken over by the engine control system 3.2, while all other engine functions continue to be operated from the engine control system 3.1. The output signals 3.1 Z and 3.1 E of the engine control system 3.1 are present but "blind" (inactive).

Since both the "injection" and "ignition" functions have been switched over to the engine control system 3.2, the control signal 3.2 Z may be present at moment $T_8$ and the control signal 3.2 E may be present at moment $T_9$ as a respective active control signal 9 Z and 9 E at the output of the coupling logic 9 and may control the power unit 2 by means of the changed time data.

If, as it has been noted earlier, additional engine functions controlled by the engine control system 3.1 are to be switched over to the engine control system 3.2, such a switchover occurs in a manner as described above, that is, at such moments when for the selected engine functions no output signal is present at either engine control system. Since the switchover occurs without interruption, the individual functions may be selectively controlled by the one or the other engine control system while the engine is running. Thus, dependent on design, functions such as ignition, injection, idling run, exhaust gas recirculation and other additional functions may be switched back and forth between the two engine control systems 3.1 and 3.2.

The coupling logic 9 has, corresponding to the number of the functions to be switched over, a like number of switches available for the user to effect the selection. FIG. 2 illustrates the switches in the coupling logic 9 as simple switches $S_1$ and $S_2$ which, however, also have timing components for an accurate switchover. The coupling logic 9 may be so designed that in case of multi-cylinder engines, a possibility of switchover of the individual signals for selected individual cylinders is also provided. Accordingly, in operation, the desired changes via the external engine control 3.2 may be effected only at the selected cylinders, while the other cylinders continue to be controlled by the engine control system 3.1 for all functions. In such a case too, only one or a plurality of functions of the selected cylinders are controlled by the external engine control system 3.2, while the other functions are controlled by the integrated engine control system 3.1. Again, a switchover is performed between the individual functions or a switchover to the individual cylinders only when no signal appears on either engine control system 3.1 or 3.2.

Figure 4:
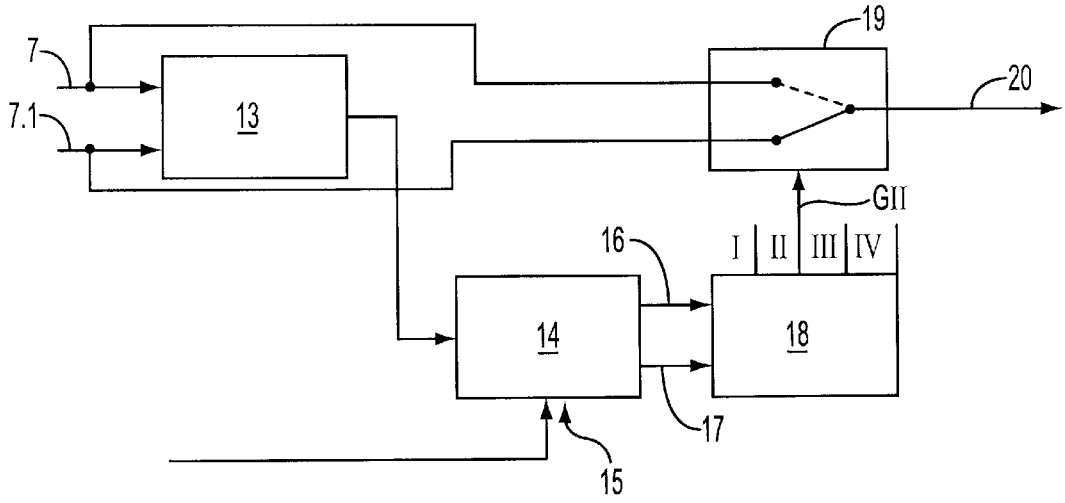
FIG. 4 is a block diagram showing a switchover unit for the ignition control of one cylinder in a four-cylinder engine.

FIG. 4 shows, as a part of the coupling logic 9, an accurately timed electronic switchover device S which operates, for example, for switching over the "ignition" function for a single cylinder of a four-cylinder engine. The signal output 7 of the engine control system 3.1, provided for the control of the ignition and the corresponding signal output 7.1 of the engine control system 3.2 are connected to an OR gate 13. As soon as one of the signals is a logic "1", at the output of the OR gate 13 a "1" appears as well. The output of the OR gate 13 is connected with a binary counter 14. A trailing flank appears at the binary counter 14 and increments the latter only when the signals have a logic "0" at both signal inputs 7 and 7.1. The binary counter 14 is synchronized by a synchronizing signal which is derived from the engine or the engine control system 3.1 and which appears once per engine cycle and supplies information concerning the actual position of the crankshaft or the cam shaft. The synchronizing signal appears, for example, in each instance when the crank for the cylinder I is situated in its upper dead center. Such a "cylinder I" signal (for example, the lower dead center prior to the high pressure phase in the cylinder I) is applied to the resetting input 15 of the binary counter 14. The binary state of the counter 14 is then applied by two conductors 16 and 17 to a decoder module (demultiplexer) 18 which, accordingly, sets that one of its outputs to "1" which is associated with the cylinder to be coupled to the external engine control system 3.2. In the switching state illustrated, such a cylinder is the cylinder II. Accordingly, the corresponding output G II of the decoder 18 is coupled with a multiplex switch 19 which can switch back and forth between ignition signals of the engine control system 3.1 and the engine control system 3.2.

Figure 5:
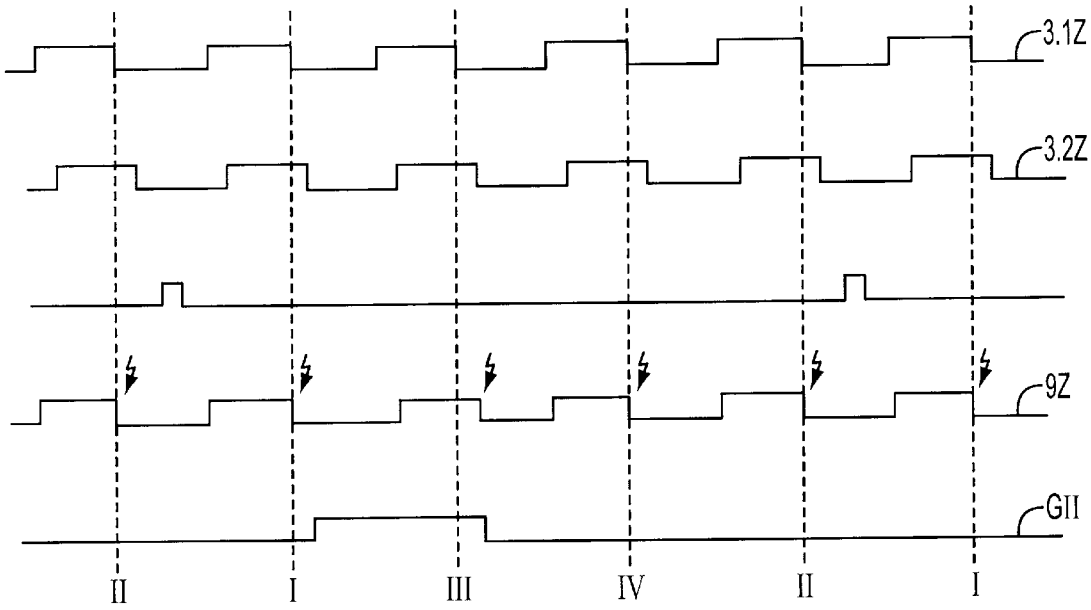
FIG. 5 is a diagram illustrating signals for the ignition function and a switchover signal in a circuit according to FIG. 4.

The switching process to be performed with the above-outlined circuit arrangement is illustrated in FIG. 5 for a switchover of the ignition at the cylinder II, similar to the illustration in FIG. 3. The top curve shows the signal sequence 3.1 Z appearing at the signal output 7 of the engine control system 3.1. The second curve from the top shows the signal sequence 3.2 Z with a time shift, appearing at the signal output 7.1 of the external engine control system 3.2. The third curve from the top is the "cylinder I" signal sequence derived from the sensor 4 or the engine control system 3.1. The "cylinder I" characterizes a full revolution of the crankshaft.

The curve 9 Z characterizes the ignition signals applied to the power unit 2 as they appear, for example, via the signal outputs 20 of the multiplex switches 19 associated with the individual cylinders as shown in the block diagram of FIG. 4. In the exemplarily illustrated four-cylinder in-line engine with an ignition sequence of I-III-IV-II, at the signal output the ignition signals of the signal curve 3.1 Z according to the curve 9 Z appear prior to a switchover. If now, based on the circuit described in connection with FIG. 4, a change of the moment of ignition in the cylinder II is desired, then according to the predetermined data corresponding to the signal curve G II, the output signal of the demultiplexer 18 is activated and the multiplex switch 19 is switched. As a result, at the cylinder II, corresponding to the signal sequence 3.2 Z, the output signal of the engine control system 3.2 appears, while all other cylinders continue to be controlled by the signal sequence 3.1 Z of the engine control system 3.1. It will be readily recognized that the output signal of the demultiplexer 18 switched via the multiplex switch 19 directly puts through the ignition data 3.1 Z of the engine control system 3.1 to the cylinders I, IV and III, while for the cylinder II the ignition data 3.2Z of the engine control system 3.2 are applied.

The circuit described in connection with FIGS. 4 and 5 for the switchover of ignition signals, that is, for the "per cylinder" switchover of the ignition signals, may be adapted under the same principle to all types of switchovers. In this manner it is then possible to selectively control not only the engine itself in its individual functions but it is also feasible to include in the electronic engine control additional aggregates such as air conditioners, fans or the like, and by connecting an external, second engine control system, to optimize their control by suitable switchover processes.

By virtue of a free programmability of the coupling logic practically no limits are set for an expansion of the interruption-free switchover between an integrated engine control system and an external engine control system during engine run. Should the user desire a switchover of other control signals, these may be integrated into the system of the interruption-free switchover by a suitable programming of the coupling logic 9 and by an adaptation of the input circuitry and the power unit.

It will be understood that the above description of the present invention is susceptible to various modifications, changes and adaptations, and the same are intended to be comprehended within the meaning and range of equivalents of the appended claims.

What is claimed is:

1. A method of controlling operation of an internal-combustion engine for examining engine functions thereof; said engine functions being at least some of ignition function, fuel injection function, exhaust gas return function, air conditioning control function and fan control function; the engine having electrically operated actuators for controlling the engine functions, comprising the following steps:

(a) detecting control-relevant operational data by sensor means;

(b) applying the detected operational data to a first, engine-integrated electronic engine control system;

(c) applying, to a power unit, control signals from the first electronic engine control system;

(d) applying the operational data to a second, external electronic engine control system in synchronism with step (b);

(e) generating control signals at an output of said second electronic engine control system;

(f) applying, to the power unit, control signals from the second electronic engine control system for the actuator of at least one engine function, selected from said engine functions, but less than all said engine functions;

(g) simultaneously with step (f), removing from said power unit control signals emanating from the first electronic engine control system for the actuator of the at least one selected engine function;

(h) individually controlling and varying, for testing, said at least one selected engine function by said second electronic engine control system; and (i) controlling engine functions other than said at least one selected engine function by said first electronic engine control system through said power unit, whereby during run of the internal combustion engine one part of the engine functions is controlled by said first electronic engine control system and, simultaneously, at least one of said engine functions is controlled by said second electronic engine control system.

2. The method as defined in claim 1, further comprising the step of starting steps (f) and (g) at a moment when no control signal emanates from either electronic engine control system.

3. A method of controlling operation of an internal-combustion engine for examining engine functions thereof; said engine functions being at least some of ignition function, fuel injection function, exhaust gas return function, air conditioning control function and fan control function; the engine having electrically operated actuators for controlling the engine functions, comprising the following steps:

(a) detecting control-relevant operational data by sensor means;

(b) applying the detected operational data in synchronism to a first, engine-integrated electronic engine control system and a second, external electronic engine control system;

(c) simultaneously producing identical control signals at an output of said first electronic engine control system and at an output of said second electronic engine control system;

(d) applying, to a power unit, control signals from the first electronic engine control system;

(e) applying, to the power unit, control signals from the output of said second electronic engine control system for the actuator of at least one engine function, selected from said engine functions, but less than all said engine functions;

(f) simultaneously with step (e), removing from said power unit control signals emanating from said first electronic engine control system for the actuator of the at least one selected engine function; and (g) individually controlling and varying, for testing, said at least one selected engine function by said second electronic engine control system through said power unit, whereby during run of the internal combustion engine one part of the engine functions is controlled by said first electronic engine control system and, simultaneously, at least one of said engine functions is controlled by said second electronic engine control system.

* * * * *